US008434915B2

(12) United States Patent
Liu et al.

(10) Patent No.: US 8,434,915 B2
(45) Date of Patent: May 7, 2013

(54) LED LAMP HAVING A RECESS IN EXTERNAL HOUSING TO RECEIVE LIGHT SOURCE

(75) Inventors: Tay-Jian Liu, Taipei Hsien (TW); Jian-Bing Qian, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 371 days.

(21) Appl. No.: 12/843,791

(22) Filed: Jul. 26, 2010

(65) Prior Publication Data

US 2011/0103037 A1 May 5, 2011

(30) Foreign Application Priority Data

Oct. 30, 2009 (CN) ..... 2009 1 0309058

(51) Int. Cl.
*G09F 7/08* (2006.01)
*F21V 21/30* (2006.01)

(52) U.S. Cl.
USPC ..... 362/362; 40/611.03; 362/269; 362/285; 362/450

(58) Field of Classification Search .. 40/611.01–611.05, 40/611.11; 220/834, 835; 362/20, 157, 183, 362/184, 190, 191, 194, 197–201, 238, 239, 362/241, 249.02, 249.03, 249.07, 249.09, 362/249.1, 249.11, 269, 285, 287, 311.02, 362/319, 322, 371, 372, 399, 418, 419, 421–427, 362/428–430, 450, 545, 800; 403/96, 97
See application file for complete search history.

(56) References Cited

U.S. PATENT DOCUMENTS

| | | | | |
|---|---|---|---|---|
| 5,887,968 | A * | 3/1999 | Logan | 362/241 |
| D586,860 | S * | 2/2009 | Yu | D20/42 |
| 2006/0221602 | A1 * | 10/2006 | Zick | 362/183 |
| 2007/0014115 | A1 * | 1/2007 | Katz et al. | 362/382 |
| 2008/0295371 | A1 * | 12/2008 | Hsu | 40/570 |
| 2010/0053943 | A1 | 3/2010 | Zick | |

FOREIGN PATENT DOCUMENTS

| | | | |
|---|---|---|---|
| CN | 2314236 | Y | 4/1999 |
| CN | 2677725 | Y | 2/2005 |
| CN | 1847718 | A | 10/2006 |
| TW | 398556 | U | 7/2000 |

* cited by examiner

*Primary Examiner* — Nimeshkumar Patel
*Assistant Examiner* — Steven Horikoshi
(74) *Attorney, Agent, or Firm* — Altis Law Group, Inc.

(57) ABSTRACT

An LED lamp includes a housing and a light source located outside the housing. An electric module is received in the housing. The housing defines a receiving recess in an outer surface thereof. The light source is connected to the electric module electrically. The light source is pivotally mounted to the housing and pivotable between a rest state and a working state to adjust an illumination angle of the light source. When the light source is located at the rest state, the light source is received in the receiving recess. When the light source is located at the working state, the light source is pivoted up from the receiving recess. The LED lamp can be used for normal illumination, emergency illumination or mobile illumination.

15 Claims, 8 Drawing Sheets

LED LAMP HAVING A RECESS IN EXTERNAL HOUSING TO RECEIVE LIGHT SOURCE

BACKGROUND

1. Technical Field

The disclosure generally relates to light emitting diode (LED) lamps, and particularly to an LED lamp which is capable of providing normal, emergency, and mobile illuminations.

2. Description of Related Art

To resolve the problem of global warming and natural resource exhaustion, low power consuming electrical devices are required. LED lamps are developed to meet the power-saving trend. LED lamps having LEDs (light emitting diodes) are preferable for substituting CCFLs (cold cathode fluorescent lamps) and other traditional lamps due to the excellent properties of the LEDs, including high brightness, low power consumption, long lifespan, environment friendliness, rapid start-up, directivity.

Nowadays, LEDs have been used in a general lamp for normal illumination, an emergency lamp for emergency illumination and a flashlight for mobile illumination. However, the conventional LED-type general lamp is individually designed for normal illumination or emergency illumination or mobile illumination. The conventional LED-type general lamp is used where an external alternating current (AC) power source is readily available, without making the most use of an environment illumination enhanced the insufficient normal illumination by auxiliary illumination for energy-saving. The conventional LED-type emergency illumination is typically installed in places such as hallways, stairs, passageways, and other areas needing an emergency illumination, without making the most use of the environment illumination extended the emergency illumination period by auxiliary illumination for safety. The conventional LED-type emergency illumination is constantly inactive, except when the AC power source to the conventional LED-type general lamp is interrupted. To equip a same area with both the general and emergency lamps is costly in money and space.

Therefore, it is desirable to provide a single LED lamp which is capable of providing normal, emergency, and mobile illumination functions.

BRIEF DESCRIPTION OF THE DRAWINGS

Many aspects of the present embodiment can be better understood with reference to the following drawings. The components in the drawings are not necessarily drawn to scale, the emphasis instead being placed upon clearly illustrating the principles of the present embodiment. Moreover, in the drawings, like reference numerals designate corresponding parts throughout the several views.

DETAILED DESCRIPTION

Figure 1:
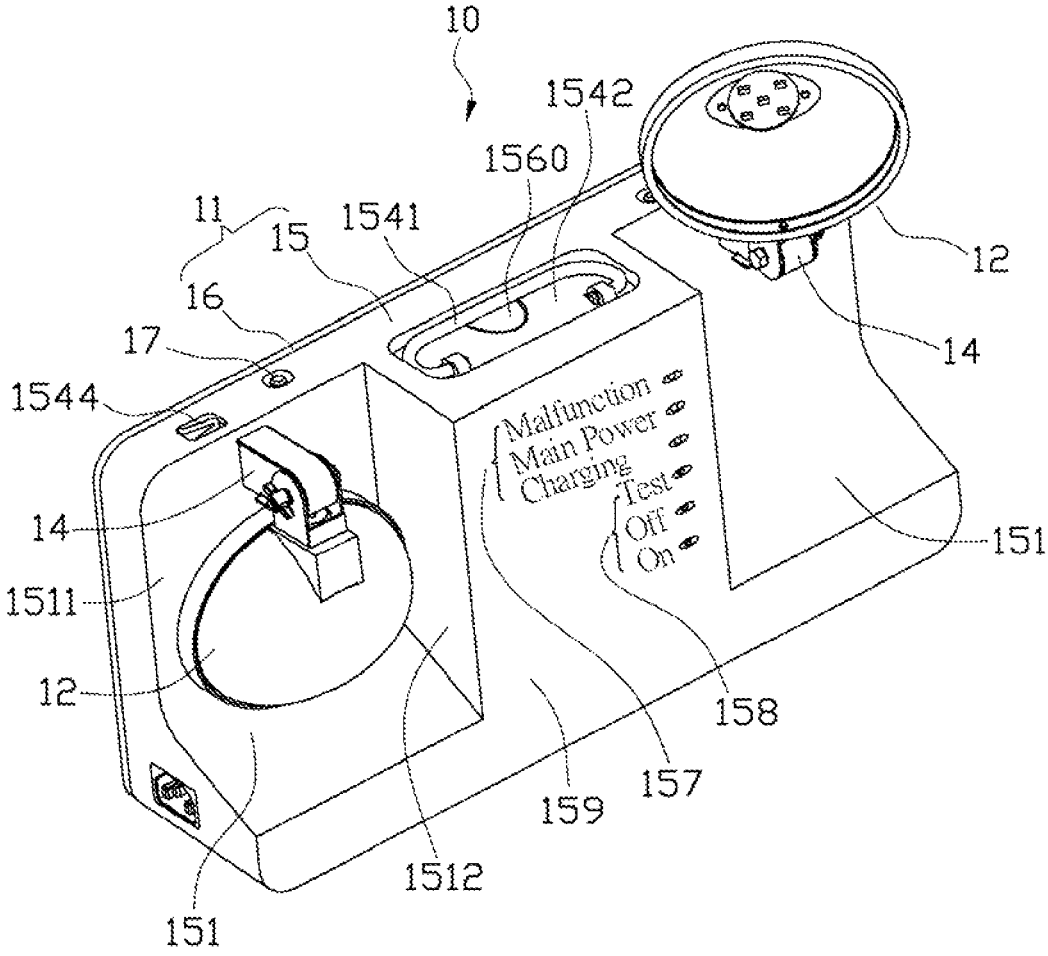
FIG. 1 is an assembled, isometric view of an LED lamp in accordance with an exemplary embodiment of the disclosure.
Figure 2:
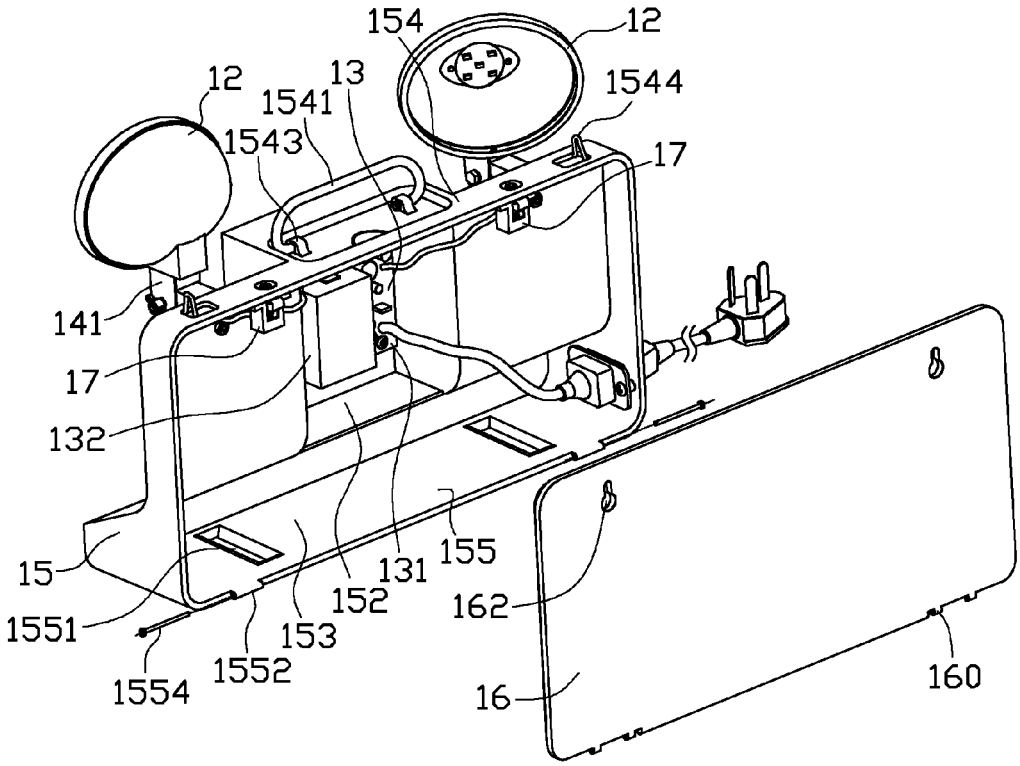
FIG. 2 is an exploded view of the LED lamp of FIG. 1.

Referring to FIGS. 1-2, an LED lamp 10 according to an exemplary embodiment of the disclosure includes a housing 11, two light sources 12 mounted to the housing 11, an electric module 13 disposed inside the housing 11, and two angle-adjusting units 14 connecting the two light sources 12 to the housing 11, respectively.

The housing 11 includes a casing 15 at a front side thereof and a cover plate 16 at a rear side thereof. The cover plate 16 is attached to the casing 15 to form the housing 11. The casing 15 defines two receiving recesses 151 in an outer surface thereof, corresponding to the two light sources 12, respectively. The two receiving recesses 151 are located at opposite lateral sides of the casing 15. Each of the light sources 12 is pivotally connected to the housing 11 via a corresponding angle-adjusting unit 14, such that each light source 12 can change its illumination angle by the angle-adjusting unit 14, whereby the light source 12 can move from a rest state to a working state, wherein the light source 12 is received in the receiving recess 151 in the rest state (referring to the light source 12 at the left side of the housing 11 in FIG. 1), and the light source 12 is moved up from the receiving recess 151 and located above a top of the housing 11 in the working state (referring to the light source 12 at the right side of the housing 11 in FIG. 1). Each of the receiving recesses 151 is defined by an outer surface 1511 parallel to the cover plate 16, and a lateral surface 1512 perpendicular to the outer surface 1511. The light source 12 is connected to the outer surface 1511 of the casing 15 by the angle-adjusting unit 14.

A receiving chamber 152 is defined in the housing 11 and between the two light sources 12. The electric module 13 is received in the receiving chamber 152, and mounted to an inner surface of the casing 15. A plurality of indication symbols 157 and a plurality of switches 158 are provided on an outer surface of the casing 15, corresponding to the electric module 13. The switches 158 include ON and OFF switches 158 for the LED lamp 10.

The casing 15 includes a top plate 154 and a bottom plate 155 at top and bottom sides thereof, respectively. The top plate 154 defines a recess 1542 therein. A pair of locking tabs 1543 are provided in the recess 1542 for mounting a handle 1541 in the recess 1542. The handle 1541 can be erected up from the recess 1542 by hand such that the LED lamp 10 can be conveniently taken to move by hand. A groove 1560 is further defined in the recess 1542, such that hand can extend into the groove 1560 to pull the handle 1541 up from the recess 1542 conveniently.

Two protrusions 1551 are formed on the bottom plate 155 and protrude downwardly. When the LED lamp 10 is placed on a platform, the LED lamp 10 is supported on the platform by the two protrusions 1551 and spaced from the platform by a distance. A receiving space 153 is defined in the housing 11 adjacent to the bottom plate 155 for receiving power wires or other components of the LED lamp 10.

Figure 3:
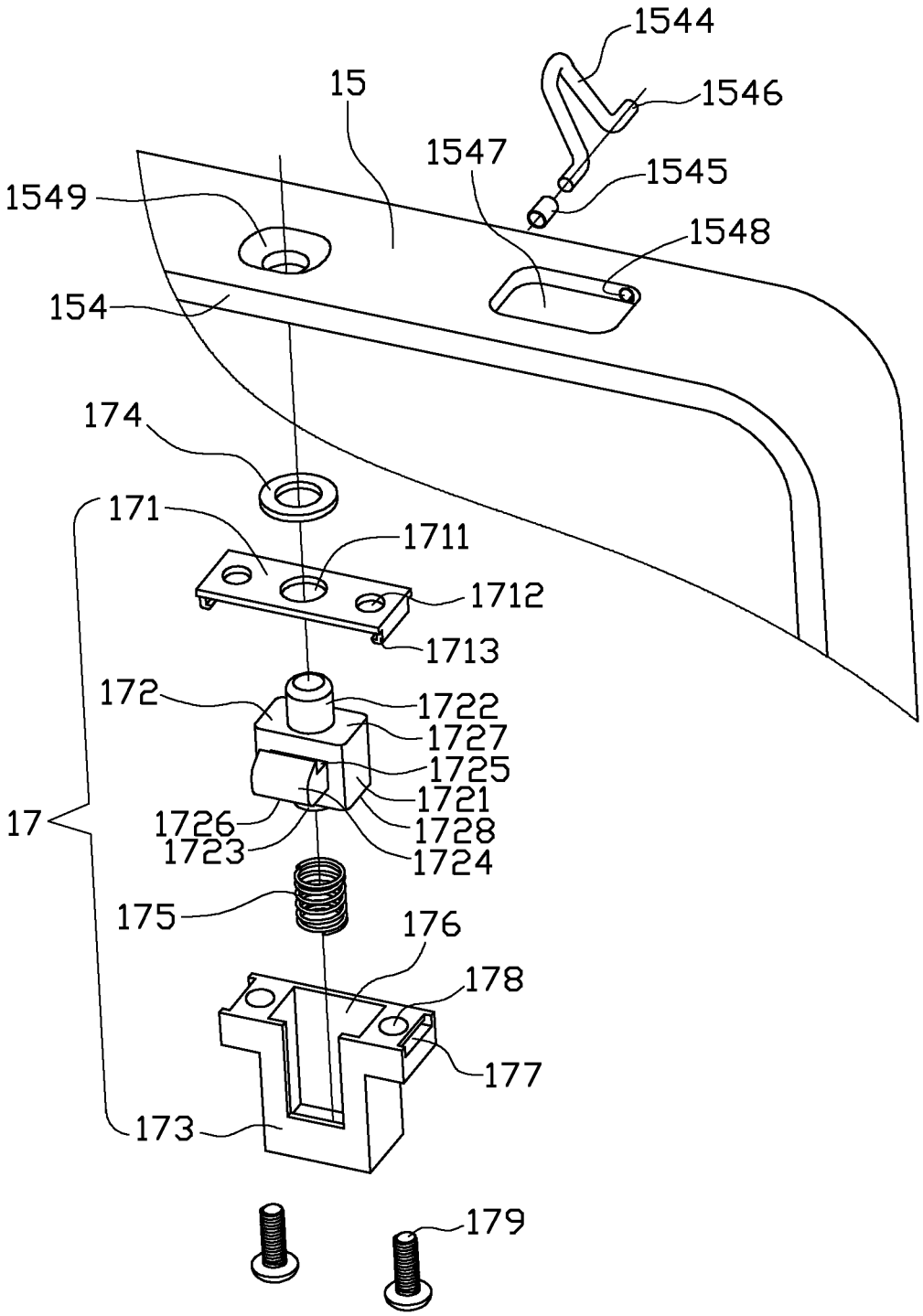
FIG. 3 is an exploded view of a clip assembly of the LED lamp of FIG. 1.

Referring also to FIG. 3, two rectangular recesses 1547 are defined at two opposite ends of the top plate 154, respectively, and two locking wires 1544 are mounted in the two recesses 1547, respectively. Particularly, two sleeves 1545 are provided and fixedly inserted in two engaging holes 1548 defined at opposite sides of each recess 1547. Two ends 1546 of each locking wire 1544 are inserted in the sleeves 1545, such that the locking wire 1544 can be erected up from the recess 1547 by hand. A belt (not shown) with two ends each fastened with a hook can be connected to the locking wires 1544 by engaging the hook with the wire 1544. The LED lamp 10 then can easily carried by a user who puts the belt over his/her shoulder.

The cover plate 16 is pivotally mounted to the casing 15. Particularly, a pair of first pivot seats 1552 are formed on the bottom plate 155 of the casing 15 and protrude outwardly from opposite sides of the bottom plate 155 towards the cover plate 16, respectively. A pair of second pivot seats 160 are formed on opposite sides of a bottom of the cover plate 16, corresponding to the two first pivot seats 1552. A pivot 1554 extends through each first pivot seat 1552 and a corresponding second pivot seat 160 to pivotally mount the cover plate 16 to the casing 15. A pair of locking holes 162 are defined in a top portion of the cover plate 16. The LED lamp 10 can be mounted to, such as, a wall (not shown) by the locking holes 162 engagingly receiving two fixtures (not shown) secured to the wall.

Two clip assemblies 17 are provided in the housing 11 for clipping the cover plate 16 to the casing 15. The clip assemblies 17 are attached to an inner side of the top plate 154 and located at the two opposite ends of the top plate 154. Each clip assembly 17 includes a mounting plate 171, a sliding block 172, a spring 175, and a mounting seat 173. The mounting plate 171 defines a through hole 1711 at a center thereof and two mounting holes 1712 at opposite sides of the through hole 1711. Two locking ears 1713 extend downwardly from opposite sides of the mounting plate 171 towards the mounting seat 173. The sliding block 172 includes a main body 1721, a first pole 1722, a second pole 1723, and an engaging barb 1724. The main body 1721 has a top surface 1727 and a bottom surface 1728. The first pole 1722 extends upwardly from the top surface 1727 and the second pole 1723 extends downwardly from the bottom surface 1728. The engaging barb 1724 extends from a lateral side of the main body 1721 towards the cover plate 16. An engaging groove 1725 is defined in a top side of the engaging barb 1724. The engaging barb 1724 has an arc-shaped guiding surface 1726 formed at a distal end thereof and facing the cover plate 16. The mounting seat 173 defines a sliding groove 176 along an axial direction thereof. Two mounting holes 178 are defined in a top surface of the mounting seat 173, corresponding to the two mounting holes 1712 of the mounting plate 171. Two locking grooves 177 are defined at opposite sides of the top surface of the mounting seat 173, corresponding to the two locking ears 1713 of the mounting plate 171. The top plate 154 of the casing 15 defines a through hole 1549 corresponding to the first pole 1722 of the sliding block 172.

In assembly, the spring 175 is disposed in the sliding groove 176 of the mounting seat 173. The second pole 1723 of the sliding block 172 is inserted in the sliding groove 176, with the spring 175 coiled around the second pole 1723. The first pole 1722 is inserted through the through hole 1711 of the mounting plate 171. The mounting plate 171 is pushed towards the mounting seat 173 until the two locking ears 1713 of the mounting plate 171 are locked in the two locking grooves 177 of the mounting seat 173. At this stage, the sliding block 172 is received in the sliding groove 176 of the mounting seat 173, the mounting plate 171 abuts on the top surface of the mounting seat 173, and the spring 175 is compressed between the mounting seat 173 and the bottom surface 1728 of the main body 1721 of the sliding block 172, such that the spring 175 exerts an upward force on the sliding block 172.

The mounting plate 171 together with the mounting seat 173 is then attached to the inner surface of the top plate 154 of the casing 15. Two screws 179 extend upwardly through the two mounting holes 178 of the mounting seat 173 and the two mounting holes 1712 of the mounting plate 171, thereby mounting the clip assembly 17 onto the top plate 154 of the casing 15. The first pole 1722 of the sliding block 172 extends upwardly through the through hole 1549 of the top plate 154 and is exposed to an outside of the top plate 154. In order to hermetically seal the through hole 1549, a gasket 174 is provided to insert around the first pole 1722 and sandwiched between the inner surface of the top plate 154 and the mounting plate 171.

Figure 5:
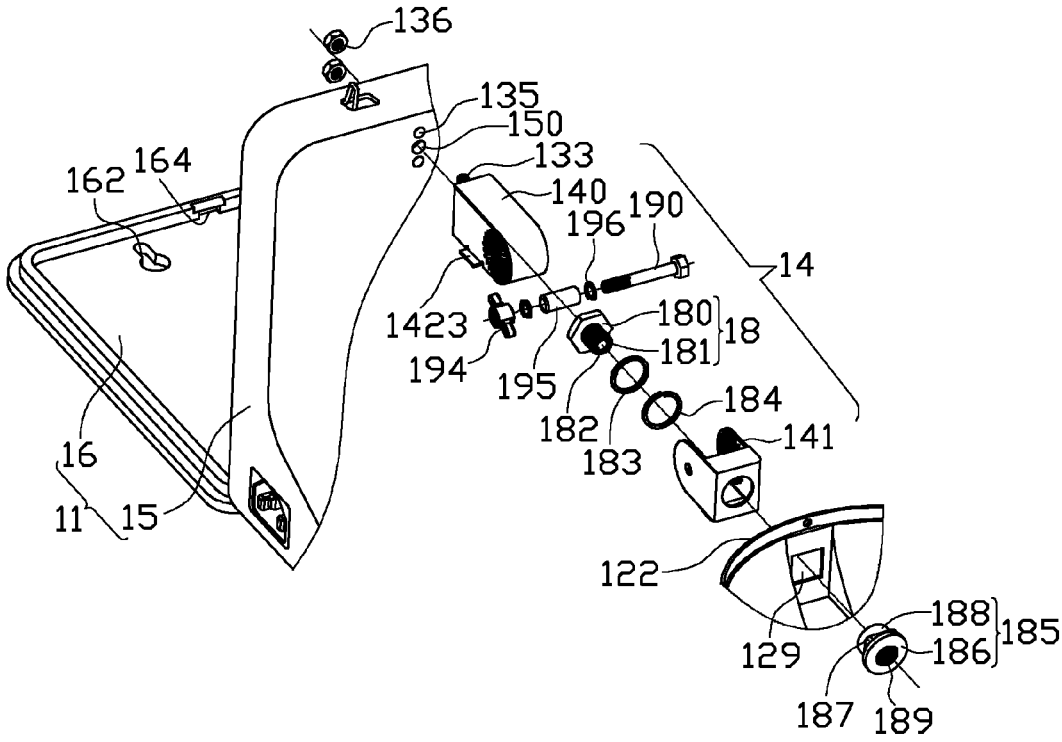
FIG. 5 is an exploded view of an angle-adjusting unit of the LED lamp of FIG. 1.

Referring to FIG. 5, the cover plate 16 forms an engaging hook 164 at a top side thereof, corresponding to the engaging barb 1724 of each clip assembly 17. In assembling the cover plate 16 to the casing 15, the bottom portion of the cover plate 16 is pivotally attached to the casing 15 via the pivots 1554, and the top portion of the cover plate 16 is pushed such that the cover plate 16 is pivoted towards the casing 15. When the engaging hook 164 enters into contact with the engaging barb 1724 of the clip assembly 17, the cover plate 16 is further pushed towards the casing 15, such that the engaging hook 164 acts on the arc-shaped guiding surface 1726 of the engaging barb 1724 and accordingly pushes the sliding block 172 to slide downwardly in the sliding groove 176 of the mounting seat 173. When the engaging hook 164 moves over the arc-shaped guiding surface 1726 of the engaging barb 1724, the spring 175 pushes the sliding block 172 to move upwardly to its original state to cause the engaging hook 164 to engage in the engaging groove 1725 of the engaging barb 1724. Thus, the cover plate 16 is fixed to the casing 15 via the interaction between the engaging hooks 164 and the clip assemblies 17. When the cover plate 16 requires to be detached from the casing 15, the exposed first pole 1722 of the sliding block 172 is pushed downwardly by hand. As a result, the sliding block 172 slides downwardly in the sliding groove 176 of the mounting seat 173 to cause the engaging hook 164 of the cover plate 16 to disengage from the engaging groove 1725 of the engaging barb 1724 of the clip assembly 17. Then, the cover plate 16 can be moved away from the casing 15 easily.

Figure 4:
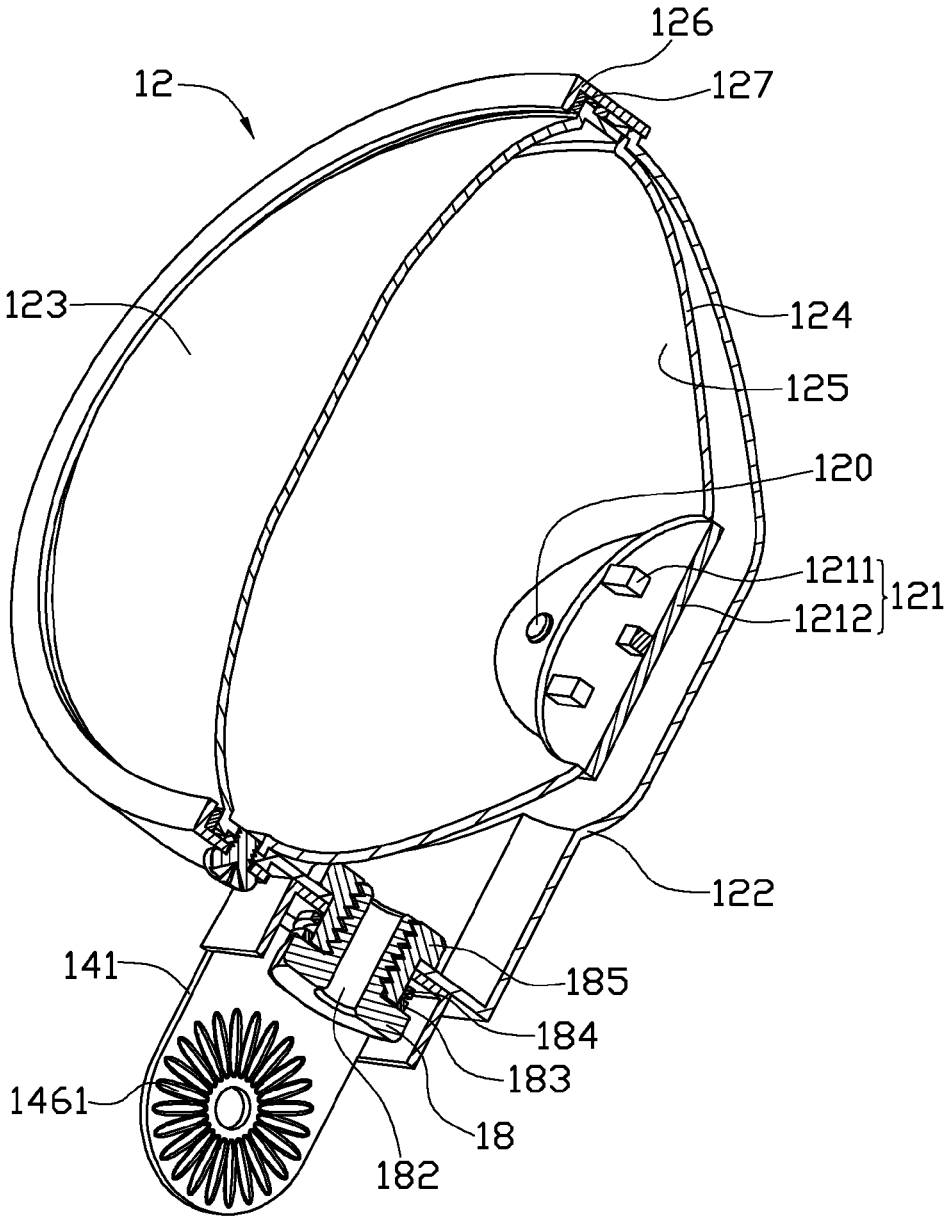
FIG. 4 is a cross-sectional view of a light source of the LED lamp of FIG. 1.

Referring to FIG. 4, the light source 12 includes a lampshade 122 and a light emitting unit 121 received in the lampshade 122 and electrically connected to the electric module 13. A cup-shaped light reflector 124 is disposed inside the lampshade 122. The light reflector 124 has an inner light reflecting surface 125 for reflecting light emitted from the light emitting unit 121. The light emitting unit 121 is mounted to the lampshade 122 through a screw 120. The light emitting unit 121 includes a circular substrate 1212 and a plurality of LEDs 1211 on the substrate 1212. The substrate 1212 is in the form of a circuit board. A cap 123 is located in front of the light emitting unit 121 and seals an open end of the lampshade 122. The cap 123 is mounted to the lampshade 122 through a circular fixing plate 126. A water-proof ring 127 is sandwiched between the fixing plate 126 and the cap 123 to hermetically seal the lampshade 122 and the cap together. The cap 123 is transparent or translucent so that light generated by the LEDs can radiate through the cap 123 to illuminate.

Figure 6:
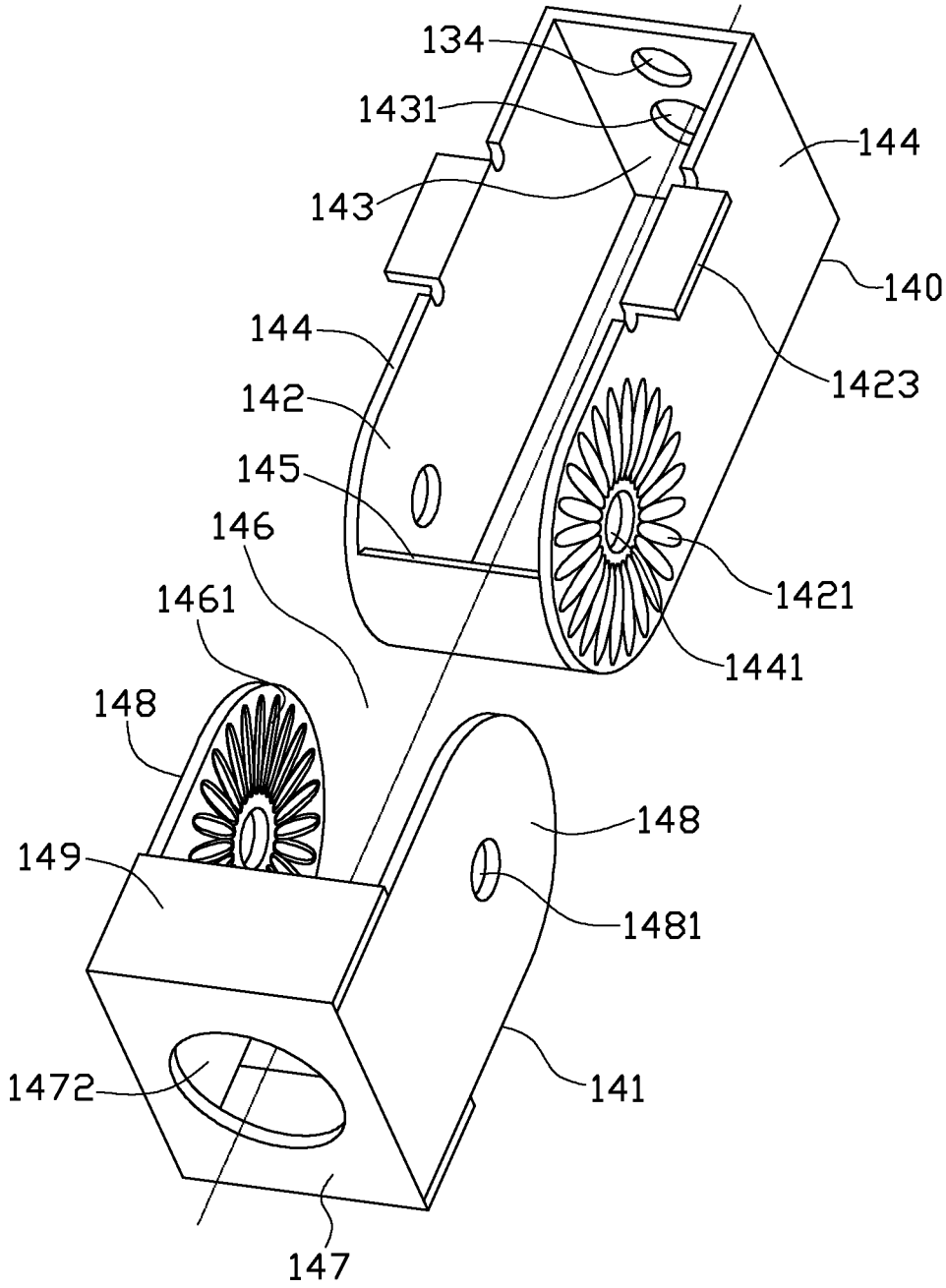
FIG. 6 is an enlarged view of a fixing element and a rotating element of the angle-adjusting unit of FIG. 5.

Referring to FIGS. 4-6, the angle-adjusting unit 14 includes a fixing element 140 and a rotating element 141. A front end of the fixing element 140 is fixed to the casing 15. The rotating element 141 is coupled to a rear end of the fixing element 140 and rotatable relative to the fixing element 140. The light source 12 is connected to the rotating element 141, such that the illumination angle of the light source 12 can be conveniently adjusted by rotating the rotating element 141 relative to the fixing element 140.

The fixing element 140 includes two sidewalls 144 parallel to each other and first and second end plates 143, 145 formed at two opposite ends of the sidewalls 144. The first end plate 143 defines a wire hole 1431 and two mounting holes 134 at opposite sides of the wire hole 1431. An opening 142 is defined in a bottom side of the fixing element 140. A limiting tab 1423 extends outwardly from a bottom of each of the sidewalls 144 for limiting a rotation angle of the rotating element 141 relative to the fixing element 140. Each sidewall 144 defines a through hole 1441 adjacent to the second end plate 145. The two through holes 1441 of the two sidewalls 144 are aligned with each other. A plurality of protruding ribs 1421 are formed on an outer surface of each sidewall 144 around the through hole 1441 and extend radially outwardly from the through hole 1441.

The rotating element 141 includes a main plate 147, two sidewalls 148 extending perpendicularly towards the fixing element 140, and two enforcing plates 149 located at top and bottom sides of the rotating element 141. The enforcing plates 149 connect the two sidewalls 148 together to reinforce the sidewalls 148. A mounting hole 1472 is defined through the main plate 147. Each sidewall 148 defines a through hole 1481 adjacent to a free end thereof. The two through holes 1481 of the two sidewalls 148 are aligned with each other. A plurality of indents 1461 are defined in an inner surface of each sidewall 148 around the through hole 1481, corresponding to the protruding ribs 1421 of the fixing element 140. The indents 1461 extend radially outwardly from the through hole 1481 of each sidewall 148. A distance between the two sidewalls 148 of the rotating element 141 is slightly larger than a distance between the two sidewalls 144 of the fixing element 140. It is noted that the protruding ribs 1421 and the indents 1461 can be interchanged, with the protruding ribs 1421 formed on the rotating element 141 and the indents 1461 defined in the fixing element 140.

Two screws 133 extend respectively through the mounting holes 134 of the first end plate 143 of the fixing element 140. The two screws 133 then extend respectively through two mounting holes 135 defined in the casing 15. Two nuts 136 engage respectively with the two screws 133 after the two screws 133 extend through the two mounting holes 135 of the casing 15, thereby mounting the fixing element 140 to the casing 15. The casing 15 defines a wire hole 150 between the two mounting holes 135, and the wire hole 150 of the casing 15 is aligned with the wire hole 1431 of the first end plate 143 of the fixing element 140.

The second end plate 145 together with a portion of the two sidewalls 144 adjacent to the second end plate 145 of the fixing element 140 is inserted between the two sidewalls 148 of the rotating element 141. Each sidewall 144 of the fixing element 140 is brought into intimate contact with a corresponding sidewall 148 of the rotating element 141. The through holes 1441 of the two sidewalls 144 of the fixing element 140 are aligned with the through holes 1481 of the two sidewalls 148 of the rotating element 141, and the protruding ribs 1421 of each sidewall 144 of the fixing element 140*s* are respectively engaged in the indents 1461 of the corresponding sidewall 148 of the rotating element 141. Then, a bolt 190, a gasket 196, a sleeve 195 and a nut 194 are provided. The sleeve 195 is inserted in the through holes 1441 of the fixing element 140 and the through holes 1481 of the rotating element 141. The bolt 190 extends through the gasket 196, the sleeve 195, and the through holes 1441, 1481 of the sidewalls 144, 148 of the fixing element 140 and the rotating element 141. The nut 194 then engages with the bolt 190 to thereby pivotally mount the rotating element 141 to the fixing element 140.

A male screw 18 and a female screw 185 are then provided to mount the light source 12 to the rotating element 141. The female screw 185 includes a head 186, a column section 188 and a rectangular anti-rotation section 187 between the head 186 and the column section 188. A thread hole 189 is defined axially through the female screw 185. The male screw 18 includes a head 180 and a threaded section 181 extending from the head 180. A wire hole 182 is defined axially through the male screw 18. The column section 188 of the female screw 185 extends through a rectangular through hole 129 defined in the lampshade 122 and then through the mounting hole 1472 of the main plate 147 of the rotating element 141. The through hole 129 of the lampshade 122 has a size and shape the same as the anti-rotation section 187, and the anti-rotation section 187 is fittingly received in the through hole 129 such that the female screw 185 cannot rotate in the through hole 129. Then, the male screw 18 extends through a first gasket 183 and a second gasket 184, and is then engaged in the thread hole 189 of the female screw 185 18, thereby mounting the light source 12 to the rotating element 141. Since the light source 12 is mounted to the casing 15 by the angle-adjusting unit 14, the rotating element 141 can rotate relative to the fixing element 140 to cause the light source 12 to move from the rest state to the working state or from the working state to the rest state. Furthermore, in the working state, the light source 12 together with the female screw 185 can be rotated relative to the rotating element 141 to further adjust the illumination angle of the light source 12, as shown in FIG. 1.

The electric module 13 includes a circuit board 131 and a rechargeable battery 132 electrically connected to the circuit board 131. A various of circuits (not shown) as needed are formed on the circuit board 131. Such circuits may include AC to DC conversion circuit, battery charging circuit, and control circuit. The LED lamp 10 can be electrically connected to an external alternating current (AC) power source by inserting a power plug (not labeled) into an AC power socket (not shown), wherein the power plug is electrically connected with the electric module 13 through electrical wires (not labeled). The light source 12 is electrically connected with the electric module 13 through electrical wires (not labeled). The electrical wires can extend sequentially through the wire hole 150 of the casing 15, the wire hole 1431 of the first end plate 143 of the fixing element 140, the wire hole 182 of the male screw 18 to electrically connect to the light source 12.

Figure 7:
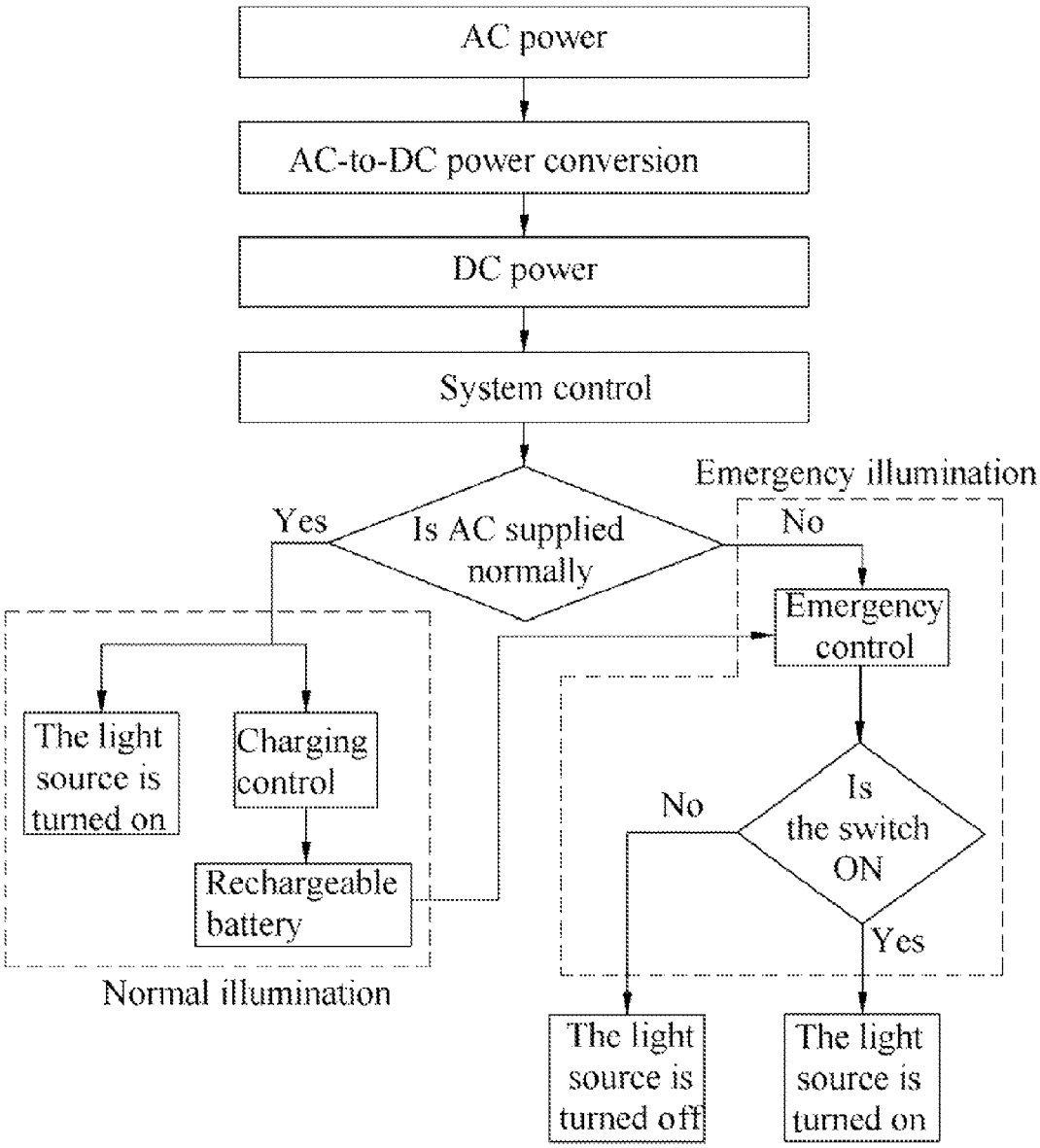
FIG. 7 is a flowchart illustrating an operation principle of the LED lamp of FIG. 1.

Referring to FIG. 7, in operation, the external AC power source is electrically connected with the circuit board 131. The AC to DC conversion circuit on the circuit board 131 converts the AC power provided by the external AC power source into direct current (DC) power. Then, system control by the control circuit is started. When the external AC power source is supplied normally, the DC power converted from the external AC power source is supplied to the light source 12 and the rechargeable battery 132. As a result, the light source 12 is turned on to emit light for providing normal illumination and at the same time, the rechargeable battery 132 is charged via charging control by the battery charging circuit.

When the external AC power source supply is interrupted, the external AC power source can no longer supply power to the light source 12. At this time, the control circuit controls the light source 12 to automatically enter into emergency control. The rechargeable battery 132 begins to supply DC current to the light source 12 for providing emergency illumination. If the On switch 158 is pressed, the rechargeable battery 132 will supply DC current to the light source 12, and the light source 12 is turned on. If the Off switch 158 is pressed, the rechargeable battery 132 will not supply DC current to the light source 12, and, the light source 12 is turned off. Accordingly, the LED lamp 10 can also be taken by person for mobile use as a flashlight.

Figure 8:
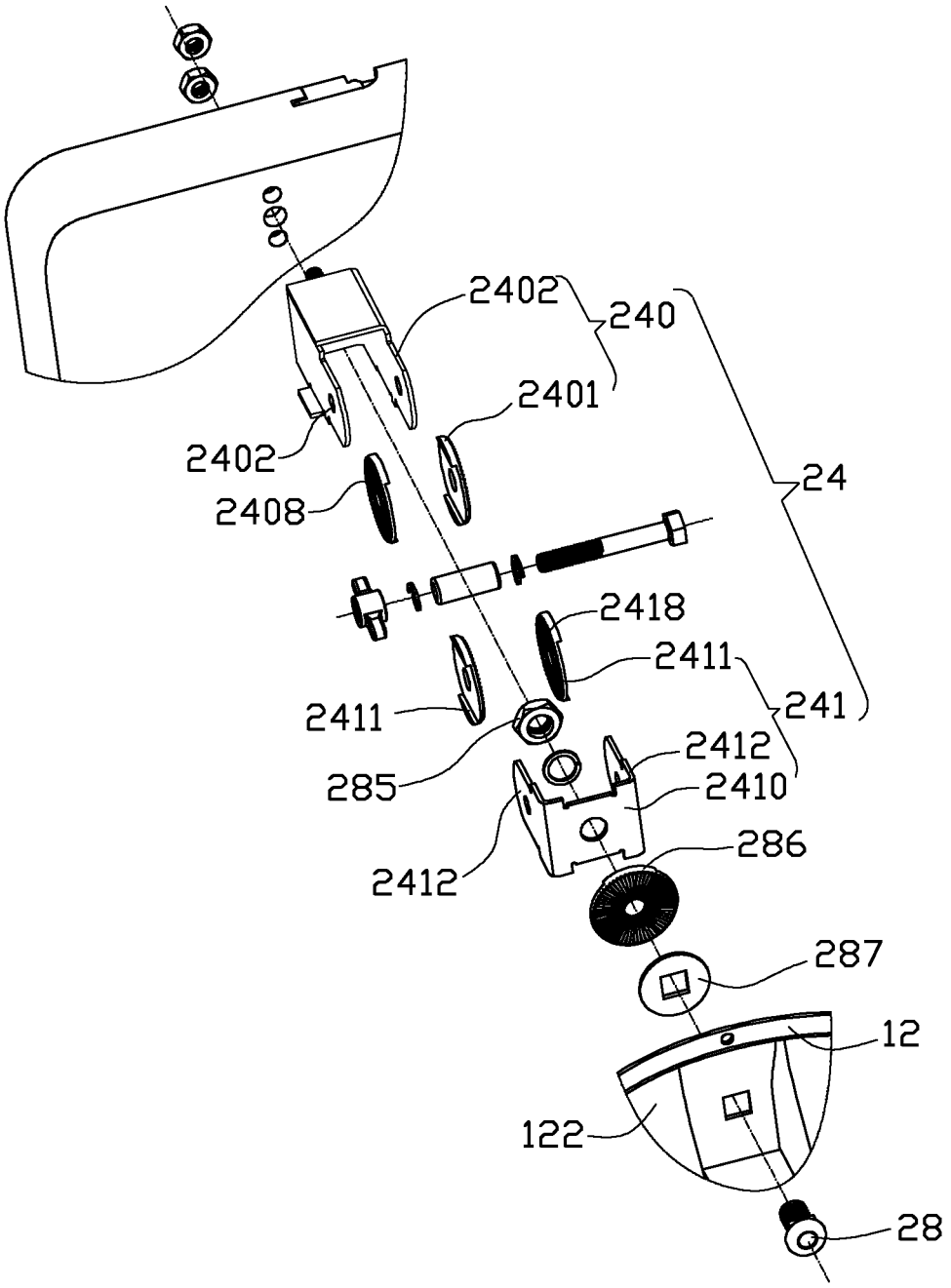
FIG. 8 is an exploded view of an angle-adjusting unit of an LED lamp in accordance with an alternative embodiment of the disclosure.

FIG. 8 shows an angle-adjusting unit 24 according to an alternative embodiment for mounting the light source 12 to the casing 15. The protruding ribs 2408 for the fixing element 240 are formed on two separate first fixing discs 2401. The two first fixing discs 2401 are mounted to the two sidewalls 2402 of the fixing element 240, respectively. The indents 2418 for the rotating element 241 are defined in two separate second fixing discs 2411. The two second fixing discs 2411 are mounted to the two sidewalls 2412 of the rotating element 241, respectively. The indents 2418 of the two second fixing discs 2411 are engaged with the protruding ribs 2408 of the two first fixing discs 2401. The rotating element 241 can rotate relative to the fixing element 240 to cause the indents 2418 of the two second fixing discs 2411 to engage with different protruding ribs 2408 of the two first fixing discs 2401 at different positions. Two separate third and fourth fixing discs 286, 287 are provided between the main plate 2410 of the rotating element 241 and the lampshade 122 of the light source 12. A plurality of protruding ribs are formed on the third fixing disc 286, and a plurality of indents are defined in the fourth fixing disc 287, corresponding to the protruding ribs of the third fixing disc 286. The lampshade 122 is mounted to the rotating element 241 by a screw 28 and a nut 285. The lampshade 122 can rotate relative to the rotating element 141 by rotating the fourth fixing disc 287 relative to the third fixing disc 286 to cause the indents of the fourth fixing disc 287 to engage with different protruding ribs of the third fixing disc 286 at different positions. In this embodiment, since the first fixing discs 2401 on which the protruding ribs 2408 are formed are separated provided from the fixing element 240 and the second fixing discs 2411 in which the indents 2418 are defined are separated provided from the rotating element 241, the fixing discs 2401, 2411 can be made of a more rigid or a more abrasion-resistant material than the fixing element 240 and the rotating element 241.

It is to be understood, however, that even though numerous characteristics and advantages of the present invention have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp, comprising:

a housing defining a receiving recess in an outer surface thereof;

an electric module received in the housing;

a light source connected to the electric module electrically, the light source located outside the housing and pivotally mounted to the housing, the housing being pivotable between a rest state and a working state to regulate an illumination angle of the light source, wherein when the light source is located at the rest state, the light source is received in the receiving recess, and when the light source is located at the working state, the light source is pivoted up from the receiving recess;

wherein the housing includes a casing and a cover plate coupled to the casing, a bottom portion of the cover plate is pivotally mounted to the casing, a top portion of the cover plate is locked with the casing through a clip assembly; and wherein the clip assembly includes a mounting plate, a sliding block, a spring, and a mounting seat, the mounting seat defines a sliding groove, the mounting plate is mounted to the mounting seat, the sliding block is received in and slideable in the sliding groove, the spring is disposed in the sliding groove and compressed by the sliding block, an engaging hook is formed on the cover plate, an engaging barb is formed on the sliding block, and the engaging hook is engaged with the engaging barb to attach the cover plate to the casing.

2. The LED lamp of claim 1, wherein the electric module includes a circuit board and a rechargeable battery electrically connected with the circuit board, when an external power source is supplied normally to the light source, the light source provides normal illumination and the rechargeable battery is charged by the external power source, and when the external AC power source supply is interrupted, the rechargeable battery supplies power to the light source for providing the emergency illumination.

3. The LED lamp of claim 1, wherein the light source is pivotally connected to the housing through an angle-adjusting unit, the angle-adjusting unit includes a fixing element fixed to the housing and a rotating element rotatably attached to the fixing element, and the light source is connected to the rotating element.

4. The LED lamp of claim 3, wherein a plurality of protruding ribs are formed on one of the fixing element and the rotating element, a plurality of indents corresponding to the protruding ribs are defined in the other one of the fixing element and the rotating element, and the protruding ribs are engaged in the indents to maintain the light source at particular illumination angle.

5. The LED lamp of claim 4, wherein the protruding ribs are formed on a separate first fixing disc, and the indents are defined in a separate second fixing disc, one of the first and the second fixing discs is mounted to the fixing element, the other one of the first and the second fixing discs is mounted to the rotating element.

6. The LED lamp of claim 4, wherein the light source includes a lampshade and a light emitting unit received in the lampshade, a through hole is defined through the lampshade, a mounting hole is defined in the rotating element, a female screw extends through the through hole of the lampshade and the mounting hole of the rotating element, and a male screw extends into a thread hole defined in the female screw to connect the light source to the rotating element.

7. The LED lamp of claim 6, wherein the female screw forms an anti-rotation section which is fittingly received in the through hole of the lampshade, and a rotation of the female screw in the through hole is prevented by the anti-rotation section, and wherein in the working state, the light source is rotatable relative to the rotating element to further regulate the illumination angle of the light source.

8. The LED lamp of claim 4, wherein two separate fixing discs are provided between the rotating element and the lampshade of the light source, a plurality of protruding ribs are formed on one of the two fixing discs, a plurality of indents are defined in the other one of the two fixing discs, the protruding ribs are engaged in the indents, and the light source is rotatable relative to the rotating element by the two fixing discs.

9. The LED lamp of claim 1, wherein the engaging barb has an arc-shaped guiding surface facing the cover plate, an engaging groove is defined in a top side of the engaging barb, and the engaging hook is engaged in the engaging groove of the engaging barb.

10. The LED lamp of claim 9, wherein a pole is formed on the sliding block, a through hole corresponding to the pole of the sliding block is defined through the casing, the pole extends through the through hole of the casing and is exposed to an outside of the housing, wherein when the pole is pushed towards an inside of the housing, the sliding block slides in the sliding groove of the mounting seat to cause the engaging hook to disengage from the engaging groove of the engaging barb.

11. An LED lamp, comprising:

a housing defining a receiving recess in an outer surface thereof;

an electric module received in the housing;

a light source connected to the electric module electrically, the light source located outside the housing and pivotally mounted to the housing, the housing being pivotable between a rest state and a working state to regulate an illumination angle of the light source, wherein when the light source is located at the rest state, the light source is received in the receiving recess, and when the light source is located at the working state, the light source is pivoted up from the receiving recess;

wherein the light source is pivotally connected to the housing through an angle-adjusting unit, the angle-adjusting unit includes a fixing element fixed to the housing and a rotating element rotatably attached to the fixing element, and the light source is connected to the rotating element;

wherein a plurality of protruding ribs are formed on one of the fixing element and the rotating element, a plurality of indents corresponding to the protruding ribs are defined in the other one of the fixing element and the rotating element, and the protruding ribs are engaged in the indents to maintain the light source at particular illumination angle; and wherein the light source includes a lampshade and a light emitting unit received in the lampshade, a through hole is defined through the lampshade, a mounting hole is defined in the rotating element, a female screw extends through the through hole of the lampshade and the mounting hole of the rotating element, and a male screw extends into a thread hole defined in the female screw to connect the light source to the rotating element.

12. The LED lamp of claim 11, wherein the electric module includes a circuit board and a rechargeable battery electrically connected with the circuit board, when an external power source is supplied normally to the light source, the light source provides normal illumination and the rechargeable battery is charged by the external power source, and when the external AC power source supply is interrupted, the rechargeable battery supplies power to the light source for providing the emergency illumination.

13. The LED lamp of claim 11, wherein the protruding ribs are formed on a separate first fixing disc, and the indents are defined in a separate second fixing disc, one of the first and the second fixing discs is mounted to the fixing element, the other one of the first and the second fixing discs is mounted to the rotating element.

14. The LED lamp of claim 11, wherein the female screw forms an anti-rotation section which is fittingly received in the through hole of the lampshade, and a rotation of the female screw in the through hole is prevented by the anti-rotation section, and wherein in the working state, the light source is rotatable relative to the rotating element to further regulate the illumination angle of the light source.

15. The LED lamp of claim 11, wherein two separate fixing discs are provided between the rotating element and the lampshade of the light source, a plurality of protruding ribs are formed on one of the two fixing discs, a plurality of indents are defined in the other one of the two fixing discs, the protruding ribs are engaged in the indents, and the light source is rotatable relative to the rotating element by the two fixing discs.

* * * * *